US007377860B2

(12) United States Patent
Breier et al.

(10) Patent No.: US 7,377,860 B2
(45) Date of Patent: May 27, 2008

(54) METAL WOOD GOLF CLUB HEAD

(75) Inventors: Joshua G Breier, Vista, CA (US); Thomas C. Morris, Carlsbad, CA (US); Kevin C. Chau, San Marcos, CA (US); Scott A. Rice, San Diego, CA (US); Peter L. Soracco, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 292 days.

(21) Appl. No.: 11/180,406

(22) Filed: Jul. 13, 2005

(65) Prior Publication Data

US 2007/0015600 A1 Jan. 18, 2007

(51) Int. Cl.
*A63B 53/04* (2006.01)
*A63B 53/06* (2006.01)

(52) U.S. Cl. ..... 473/334; 337/345

(58) Field of Classification Search ..... None
See application file for complete search history.

(56) References Cited

U.S. PATENT DOCUMENTS

| | | | | |
|---|---|---|---|---|
| 5,947,840 | A | 9/1999 | Ryan | |
| 6,409,612 | B1 | 6/2002 | Evans et al. | |
| 6,440,009 | B1 | 8/2002 | Guibaud et al. | |
| 6,773,360 | B2 | 8/2004 | Willett et al. | |
| 7,140,974 | B2 * | 11/2006 | Chao et al. | 473/329 |
| 7,160,040 | B2 * | 1/2007 | Matsushima | 400/62 |
| 7,163,468 | B2 * | 1/2007 | Gibbs et al. | 473/329 |
| 2002/0137576 | A1 | 9/2002 | Dammen | |
| 2004/0176177 | A1 | 9/2004 | Mahaffey et al. | |
| 2004/0242343 | A1 | 12/2004 | Chao et al. | |

* cited by examiner

*Primary Examiner*—Alvin A Hunter
(74) *Attorney, Agent, or Firm*—D. Michael Burns

(57) ABSTRACT

An improved golf club head is disclosed which comprises the positioning of secondary weights at such low, rearward and outward locations that it causes an alteration in the traditional look of the club head wherein each secondary weight has a portion of the weight that bulges outwards of the natural contour of the club head.

12 Claims, 5 Drawing Sheets

METAL WOOD GOLF CLUB HEAD

FIELD OF THE INVENTION

The present invention relates generally to a metallic hollow golf club head, and specifically, to the placement of secondary weights.

BACKGROUND OF THE INVENTION

Golf club "metal woods", were originally manufactured primarily by casting of durable metals such as stainless steel, aluminum, beryllium copper, etc. into a unitary structure comprising of a metal body, face and hosel. As technology progressed it became more desirable to strengthen the face of the club, and usually this was achieved by using a titanium material.

With a high percentage of amateur golfers constantly searching for more distance on their drives, the golf industry has responded by providing golf clubs specifically designed to increase distance. The head sizes have increased, which allows for the club to possess a higher moment of inertia, and this translates to a greater ability to resist twisting on off-center hits. As a wood head becomes larger, its center of gravity will be moved back away from the face and further toward the toe resulting in hits flying higher and to the right than expected (for right-handed golfers). Reducing the lofts of the larger head clubs can compensate for this. Also the larger heads, because the center of gravity is moved further away from hosel axis, can cause these clubs to remain open on contact, thereby inducing a "slice" effect (in the case of a right-handed golfer the ball deviates to the right). Offsetting the head and incorporating a hook face angle can help compensate for this by "squaring" the face at impact, but often more is required to eliminate the "slice" tendency. The present invention provides such a solution.

Another technological breakthrough in recent years towards providing the average golfer with more distance is to make larger head clubs, while keeping the weight constant or even lighter, by casting consistently thinner shell thickness and going to lighter materials such as titanium, magnesium and composites. Also the faces of the clubs have been steadily becoming extremely thin, wherein the thinner face will maximize what is known as the COR (Coefficient of Restitution). The more a face rebounds upon impact, the more energy that may be imparted to the ball, thereby increasing distance.

The prior art teaches methods to enhance the weight distribution of metal woods to help reduce the club from being open on contact with the ball. Usually, this is accomplished by the addition of weights to the body casting itself or strategically adding a weight element at some point in the club. Many efforts have been made to incorporate weight elements into the metal wood head. They are usually placed at specific locations, which will have a positive influence on the flight of the ball or to overcome a particular golfer's shortcomings. As previously stated, a major problem area of the higher handicap golfer is the tendency to "slice" which besides deviating the ball to the right, also imparts a greater spin to the ball which reduces overall distance. To reduce this tendency, the present patent teaches the placing of weight elements directly into the club head. The placement of weight elements is designed so that the spin of the ball will be reduced, and also a "draw" (a right to left ball flight for a right-handed golfer) will be facilitated into the ball flight. This ball flight pattern is also designed to help the distance challenged golfer because a lower spinning ball will generally roll a greater distance after hitting the ground than it would roll with a higher spin. The present invention provides such a golf club.

SUMMARY OF THE INVENTION

In accordance with one aspect of the invention, a metal wood golf club head is provided which includes a substantially hollow club head having a metal front face welded to it, a sole plate, a crown portion, a toe portion, a heel portion, a skirt portion connecting the heel portion to the toe portion, and secondary weights in an extremely and back from the front face portion. A center point on the sole plate defines the lowest point on the club head and it is located directly below the center of gravity of the club head when the club head is at a 59° lie. The center of gravity of the secondary weights are positioned a pre-determined distance from the center point. Each center of gravity is: at least 0.5 inch rearward of the center point; at least 0.75 inch from the center point toward the heel for the heel weight; at least 0.75 inch for the toe weight; and a maximum 0.25 inch above the center point, whereby the position of the weights alter the traditional look of the golf club head by bulging outward of the natural contour of the club head.

One embodiment provides a method of positioning the secondary weights by reference to a point wherein the centerline of the hosel intersects the sole plate. This distance is then measured from the back surface of the front face at the midpoint of the front face to determine a intersection point. The secondary weights are each at least 1.50 inches rearward of the intersection point, at least 0.75 inch toward either the heel or the toe, and a maximum of 0.25 inch above the center point with the club head at a 59° lie.

DETAILED DESCRIPTION OF THE PREFERRED EMBODIMENTS

Figure 1:
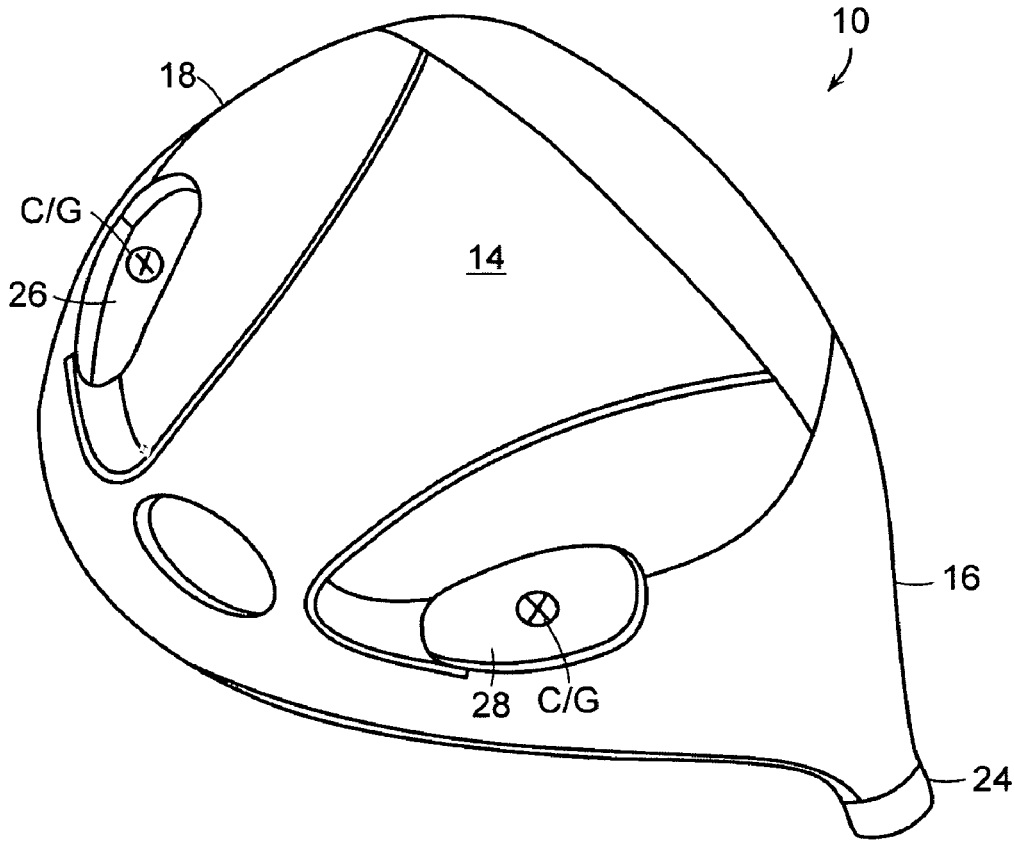
FIG. 1 is a bottom perspective view of the club head of the present invention.
Figure 2:
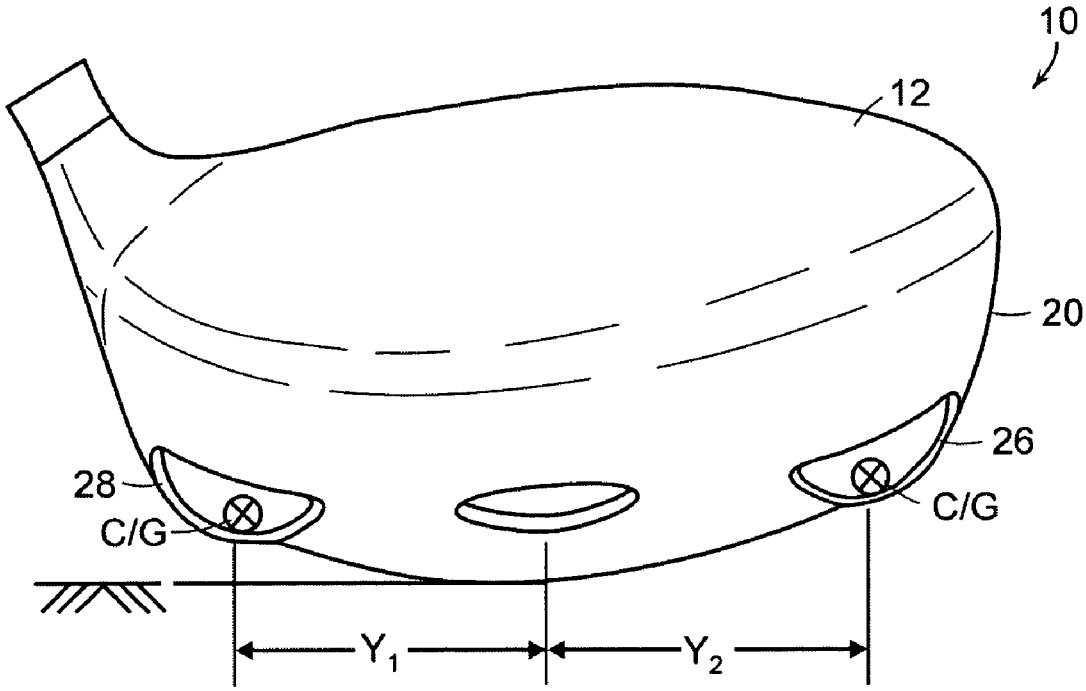
FIG. 2 is a rear elevational view of the club head of the present invention.
Figure 3:
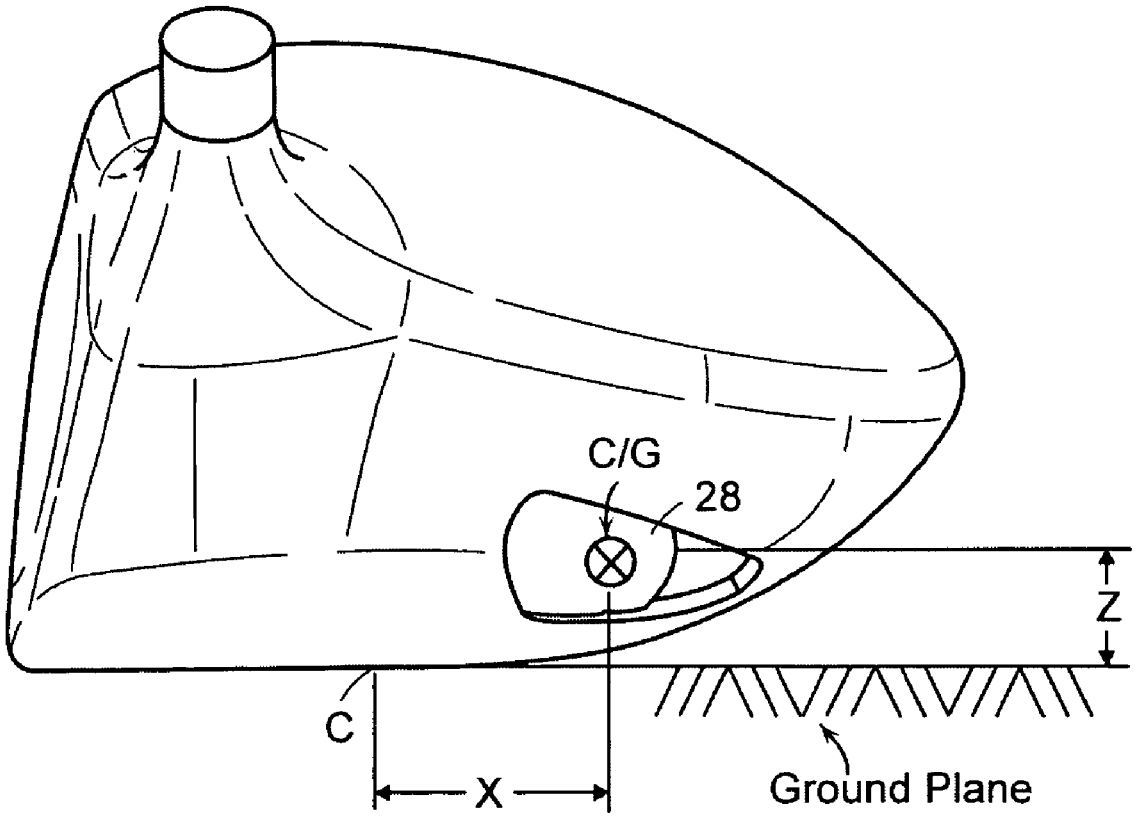
FIG. 3 is a heel elevational view thereof.

In FIGS. 1-5, there is provided a substantially hollow golf club head 10. The head 10 includes a crown portion 12, a sole plate 14, a heel portion 16, a toe portion 18, a skirt portion 20 connecting the heel portion 16 to the toe portion 18, a front face 22 and a hosel 24 that extends from the heel portion 16. The club head 10 can be formed from sheets welded together or cast, preferably from a titanium alloy. The crown portion 12 can be made from such materials as carbon fiber composite, polypropylene, Kevlar, magnesium, or a thermoplastic. Hosel 24 includes a bore defining a centerline axis C/L.

Figure 4:
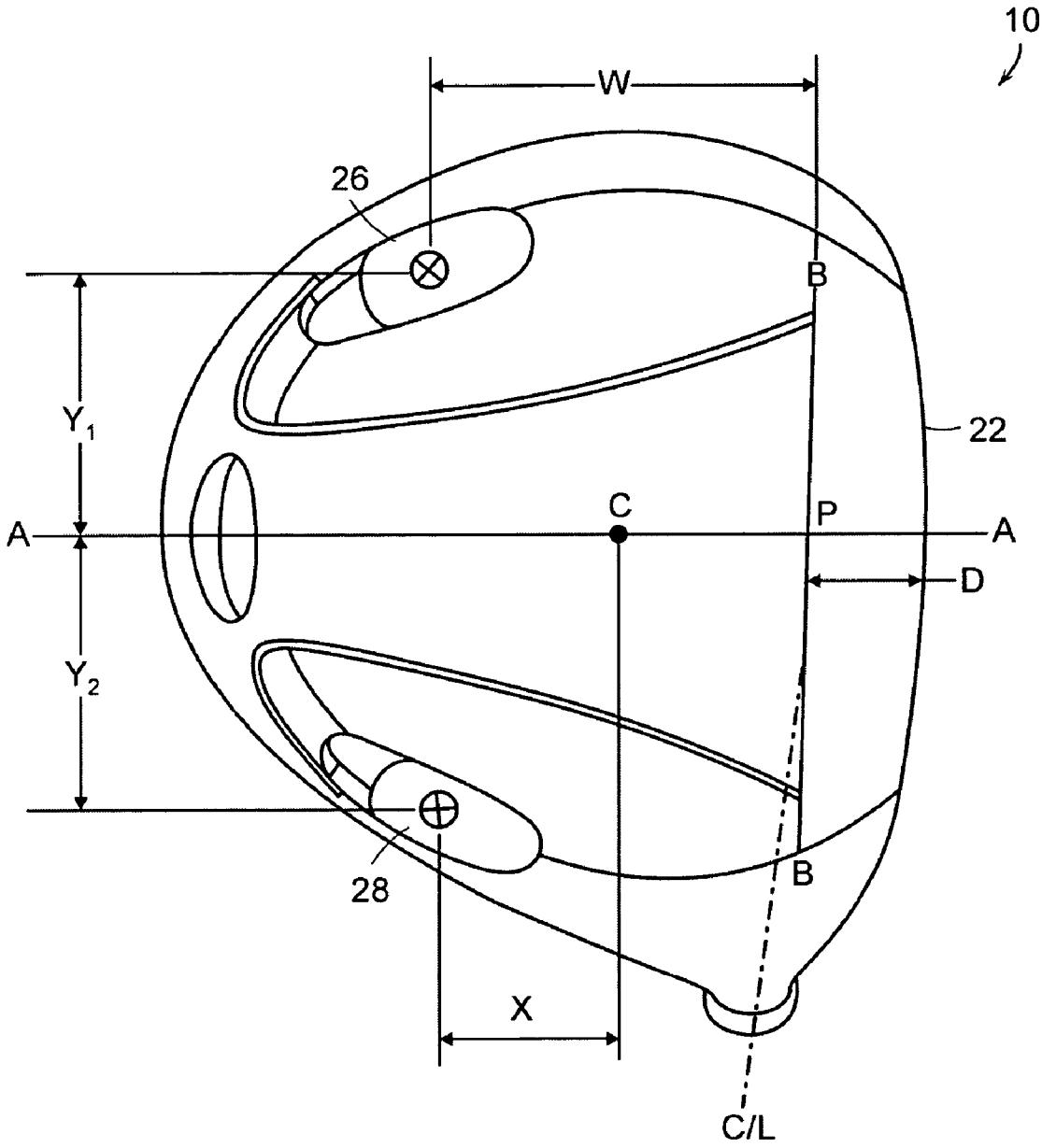
FIG. 4 is a bottom schematic view thereof.
Figure 5:
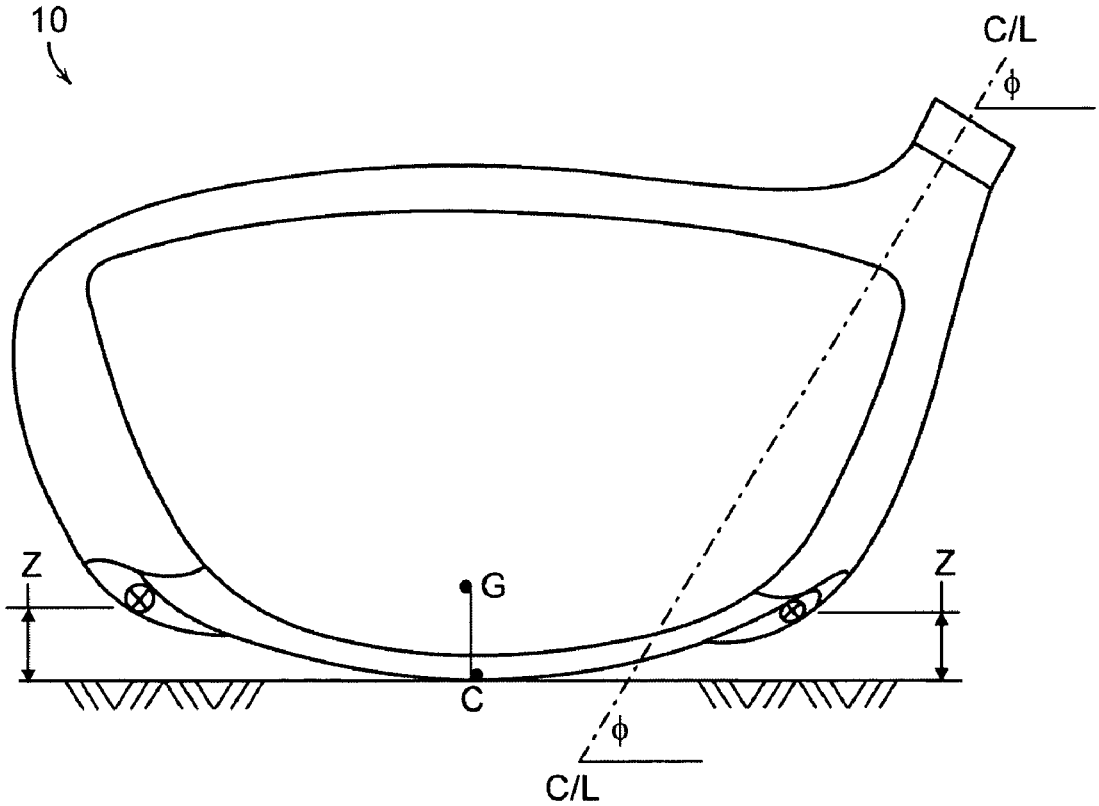
FIG. 5 is a front cross-sectional view thereof.

As best depicted in FIG. 5, the club head 10 of the present invention has a center of gravity (G) located at an extremely rearward and low position. The center of gravity (G) being created by the location of two secondary weights, a toe secondary weight 26, and a heel secondary weight 28 which are both partially outside the traditional look of a club head. As shown in FIGS. 1-5, the locations of the two secondary weight elements 26, 28 are established by the relationship of their distances from established points of contact. When the club head is at a lie angle ø of 59°, the lowest contact point of the sole plate 14 is at a center point (C) directly beneath the center of gravity (G).

One method of establishing the locations of the secondary weights 26, 28 is discussed herein. As shown in FIG. 4, the center line C/L of hosel 24 intersects the sole plate 14 at a distance (D) from the rear surface of the front face 22. When extending a substantially parallel line B-B (maintaining the distance (D), an intersection point (P) is made with a line A-A that is perpendicular to and extends rearward from the midpoint of the front face 22. The line A-A extends through the middle of the club head 10 and passes directly beneath the club head center of gravity (G). The center of gravity (C/G) of each secondary weight 26, 28 is: at a distance W which is at least 1.50 inches rearward of the intersection point (P); a distance Z which is a maximum of 0.25 inch above the lowest point of contact which is the center point (C) of the sole plate 14; and, each secondary weight is at least 0.75 inch away from line A-A in opposing directions which is a distance $Y_2$ towards the toe for the toe secondary weight 26 and a distance $Y_1$ towards the heel for the heel secondary weight 28.

The locations of the secondary weights 26, 28 may also be determined for the present invention by measuring from the center point (C). From center point (C) the center of gravity of each secondary weight 26, 28 is: a distance X which is at least 0.50 inch rearward along line A-A; the distance Z which is a maximum of 0.25 inch above the center point (C); and they are each a minimum of 0.75 inch away from line A-A in opposing directions which is towards the toe for the toe secondary weight 26 and towards the heel for the heel secondary weight 28. Thus each secondary weight 26, 28 is a minimum of 0.90 inch from the center point (C).

The secondary weights 26, 28, can be selected from a plurality of weights designed to make specific adjustments to the head weight. They can be welded into place or attached by a bonding agent. The weights 26, 28, can be formed from typically heavy weight inserts such as steel, nickel or tungsten. The body of the club head 10 is preferably formed from titanium and the crown portion 12 made from a lightweight material such as carbon fiber composite, polypropylene, Kevlar, thermoplastic, magnesium, or some other suitable lightweight material. The volume of the club head 10 ranges from 350 cc to 460 cc. The secondary weights 26, 28, range in weight from 10 grams to 35 grams. It is well known that by varying parameters such as shaft flex points, weights and stiffness, face angles, and club lofts, it is possible to accommodate a wide spectrum of golfers. But, the present invention addresses the most important launch consideration which is to optimize the club head's mass properties (center of gravity and moment of inertia) by creating a center of gravity that is low, rearward and wide of center. The club head 10 of the present invention encompasses areas of the club head that are not typically utilized for weighting since they adversely alter the traditional look of a club head. The design of this club head 10 allows for a portion of the secondary weights 26, 28, to bulge outside the normal contour of the club head.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A metal wood golf club head adapted for attachment to a shaft comprising:

a substantially hollow club head including a heel portion, a toe portion, a crown portion, a sole plate, a skirt portion connecting the heel portion to the toe portion, and a front face;

a center point on the sole plate defining the lowest point of the club head, the center point being directly below the club head center of gravity when the club head is at a lie of 59 degrees;

a heel secondary weight and a toe secondary weight, each secondary weight having a center of gravity positioned a predetermined distance from the center point; and the center of gravities of the heel and toe secondary weights each being at least 0.5 inch rearward of the center point, at least 0.75 inch from the center point towards the heel for the heel secondary weight and towards the toe for the toe secondary weight, and a maximum of 0.25 inch above the center point, wherein the position of the secondary weights causes an alteration in the traditional look of the club head wherein each bulges outwards of the natural contour of the club head.

2. The golf club head of claim 1, wherein the club head volume is between 350 cc and 460 cc.

3. The golf club head of claim 1, wherein the secondary weights are formed from tungsten or steel or nickel.

4. The golf club head of claim 1, wherein the crown portion is made from a lightweight material selected from the group consisting of carbon fiber composite, polypropylene, or magnesium.

5. A metal wood golf club head adapted for attachment to a shaft comprising:

a substantially hollow club head including a heel portion, a toe portion, a crown portion, a sole plate, a skirt portion connecting the heel portion to the toe portion, and a front face;

a center point on the sole plate defining the lowest point of the club head, the center point being directly below the club head center of gravity when the club head is at a lie of 59 degrees;

an intersection point perpendicular to the midpoint of a rear surface of the front face at a distance from the front face determined by the distance between the intersection of the hosel centerline with the sole plate of the club head;

a pair of secondary weights, a heel secondary weight and a toe secondary weight, each secondary weight having a center of gravity positioned a predetermined distance from the intersection point; and the center of gravity of the heel weight and toe weight each being at least 1.5 inches rearward of the intersection point, each being at least 0.75 inch from the intersection point in a direction towards the heel portion for the heel secondary weight and towards the toe portion for the toe secondary weight, and each weight a maximum of 0.25 inch above the center point on the sole plate, wherein the position of the secondary weights causes an alteration in the traditional look of the club head wherein each bulges outwards of the natural contour of the club head.

6. The golf club head of claim 5, wherein the club head volume is between 350 cc and 460 cc.

7. The golf club head of claim 5, wherein the secondary weights are formed from tungsten or nickel or steel.

8. The golf club head of claim 5, wherein the crown portion is made from a lightweight material selected from the group consisting of carbon fiber composite, polypropylene, or magnesium.

9. A metal wood golf club head adapted for attachment to a shaft comprising:

a substantially hollow club head including a heel portion, a toe portion, a crown portion, a sole plate, a skirt portion connecting the heel portion to the toe portion, and a front face;

a center point on the sole plate defining the lowest point of the club head, the center point being directly below the club head center of gravity when the club head is at a lie of 59 degrees, a plurality of secondary weights, each secondary weight having a center of gravity positioned at least 0.9 inch from the center point; and wherein the position of the secondary weights causes an alteration in the traditional look of the club head wherein each bulges outwards of the natural contour of the club head.

10. The golf club head of claim 9, wherein the club head volume is between 350 cc and 460 cc.

11. The golf club head of claim 9, wherein the secondary weights are formed from tungsten or steel or nickel.

12. The golf club head of claim 9, wherein the crown portion is made from a lightweight material selected from the group consisting of carbon fiber composite, polypropylene, or magnesium.

* * * * *